US006305706B1

(12) United States Patent
Resch

(10) Patent No.: US 6,305,706 B1
(45) Date of Patent: Oct. 23, 2001

(54) PLATE-LIKE SUPPORT ELEMENT, IN PARTICULAR FOR A SKI BINDING

(75) Inventor: Franz Resch, Schladming (AT)

(73) Assignee: Atomic Austria GmbH, Pongau (AT)

( * ) Notice: Subject to any disclaimer, the term of this patent is extended or adjusted under 35 U.S.C. 154(b) by 0 days.

(21) Appl. No.: 09/499,062

(22) Filed: Feb. 4, 2000

(30) Foreign Application Priority Data

Feb. 5, 1999 (AT) ..... 84/99 U

(51) Int. Cl.[7] ..... A63C 5/07
(52) U.S. Cl. ..... 280/602; 280/607; 280/617
(58) Field of Search ..... 280/602 D, 607, 280/617, 636, 634

(56) References Cited

U.S. PATENT DOCUMENTS

| | | | | |
|---|---|---|---|---|
| 4,792,156 | * | 12/1988 | Hue | 280/636 |
| 5,046,751 | * | 9/1991 | Scherubl | 280/607 |
| 5,242,188 | * | 9/1993 | Bigler et al. | 280/602 |
| 5,480,175 | * | 1/1996 | Astier et al. | 280/607 |
| 5,513,872 | * | 5/1996 | Arduin et al. | 280/602 |
| 5,540,458 | * | 7/1996 | Arduin et al. | 280/602 |
| 5,636,856 | * | 6/1997 | Luitz et al. | 280/607 |
| 5,647,605 | * | 7/1997 | Arduin | 280/602 |
| 5,671,939 | * | 9/1997 | Pineau | 280/602 |
| 5,687,982 | * | 11/1997 | Challande et al. | 280/607 |
| 5,730,457 | * | 3/1998 | Couderc et al. | 280/602 |

FOREIGN PATENT DOCUMENTS

| | | | | |
|---|---|---|---|---|
| 396 749 | | 11/1993 | (AT) . | |
| 2752206 | * | 5/1979 | (DE) | 280/617 |
| 41 24 965 | | 2/1992 | (DE) . | |
| 297 15 468 | | 11/1997 | (DE) . | |
| 612545 | * | 8/1994 | (EP) | 280/607 |
| 685 244 | | 12/1995 | (EP) . | |

* cited by examiner

*Primary Examiner*—Brian L. Johnson
*Assistant Examiner*—Elaine Gort

(57) ABSTRACT

A plate-like support element (1) for coupling elements (5), in particular a heel piece (7) and a toe piece (8) of a ski binding (6), which is arranged between the coupling elements (5) and a surface (2) of the ski (3) and is designed in several parts in ski longitudinal direction. The support element (1) is formed by a support profile (9, 12) supporting the heel piece (7) and the toe piece (8) spaced apart from the surface (2) of the ski (3) by plate-like damping inserts, which support profiles are secured spaced apart on the surface (2) of the ski in ski longitudinal direction by a spacing element (17) connected between the support profiles (9, 12) and to the latter by means of elastically designed hinge arrangements (20, 21).

18 Claims, 3 Drawing Sheets

PLATE-LIKE SUPPORT ELEMENT, IN PARTICULAR FOR A SKI BINDING

BACKGROUND OF THE INVENTION

1. Field of the Invention

The invention relates to a plate-like support element for coupling elements, in particular for a ski binding, which is arranged between the coupling elements and the surface of the ski and is designed to comprise several parts along the longitudinal extension of the ski.

2. The Prior Art

A support element is known from DE 41 24 965 A1, which is arranged between the coupling elements and the surface of a ski and is formed by two mounting sections spaced apart from one another along the longitudinal extension of the ski for damping elements forming the coupling elements. The damping elements comprise spacing elements provided with bores running perpendicular to a surface of the ski, which are penetrated by securing elements, by which the coupling elements are connected movably to the ski. A disadvantage of this design is the introduction into the ski of clamping forces acting between a ski shoe and the coupling elements as a result of which its bending characteristics are changed and its damping behaviour is also worsened by the support of the coupling elements on the ski surface by the spacing elements.

A further plate arranged on a surface of a ski for mounting a ski binding is known from AT 396 749 B, which comprises a continuous plate-like damping elements common to both coupling elements, by means of which and by means of spacers are arranged for mounting the ski binding elements that are spaced apart from the surface of the ski and spaced apart from one another along the longitudinal extension of the ski. The plates have depressions for mounting the heads of securing elements which penetrate the plates and the damping element, whereby between the plate and the heads of the fastening screws connecting the plates to the ski, damping rings are arranged, in order to permit relative movements caused by the bending and vibration of the ski. A disadvantage is the reduced lateral sensitivity, which makes precise ski guiding more difficult with high lateral forces.

SUMMARY OF THE INVENTION

The objective of the present invention is to create a plate-like support element which does not restrict the deformation movements of the ski and prevents the transfer of the thus produced vibrations and oscillations to the coupling elements. This objective is achieved in that the support element is formed by a support profile supporting the heel piece and the toe piece spaced apart from the surface of the ski by means of plate-like damping inserts, which are secured spaced apart on the surface of the ski along the longitudinal extension of the ski by a spacing element connected between the support profiles and to the latter by means of elastically designed hinge arrangements. The surprising advantage of this design is that the division of the support element into the support profiles for the coupling elements and the articulated connection of the latter with a spacing element spacing apart the latter, the damping effect of the support elements is retained regardless of the deflection caused by bending and vibration of the ski to an extent that can be predetermined by the material properties of the damping insert and to an almost constant order of magnitude and in this way a reliable and fatigue-free skiing on skis equipped in this way is achieved because of the absence of fluctuating influences on the user.

Further designs are advantageous, where means of which a vibration uncoupling between the ski and coupling element is achieved by fastening the support profiles by means of the fastening arrangement adjacent to the assembly point designed as a fixed bearing and the fastening arrangement for the support element spaced apart therefrom designed as a movable bearing and the vibration uncoupling is provided in that the coupling elements are fastened on the support profiles spaced apart from the ski surface by the interconnection of damping inserts, and thus the force flow occurs between the coupling elements and the ski via the vibration damping insert. In order to achieve the necessary retaining forces for the fastening elements of the coupling elements an insert made from high-strength material is provided, which is arranged as an otherwise loose flat stamped or cut out blank element between the support profile. In this case it is advantageous to characterise the region over which the insert extends, e.g. by means of a contour projecting on the surface of the support profile to facilitate the assembly procedure and the secure attachment of the fastening elements. The design of the support profile as a plastic injection moulding permits economical manufacture whilst maintaining constant quality of the parts. By means of the suitable selection of material for the damping insert and its dimensions, in particular the thickness, the support element can be adjusted to different conditions that are dependent on skiing ability and the intended use.

The design of the spacing element with an U-shaped cross section and side webs, which support the spacing element on the surface of the ski, is advantageous, as in this way a damping effect is also achieved in the region of the spacing element to reduce oscillations and vibrations, and in addition the penetration of snow, ice, dirt etc. and thereby a reduction in the function of the support element is effectively avoided. By means of providing slots in the side webs flexibility against bending and torsion is effectively maintained.

BRIEF DESCRIPTION OF THE DRAWINGS

For a better understanding of the invention the latter is explained in more detail with reference to the embodiments shown in the drawings, wherein.

DETAILED DESCRIPTION OF PREFERRED EMBODIMENTS

First of all, it should be noted that in the various embodiments described the same parts are given the same reference numbers and the same component names, whereby the disclosures throughout the whole description can be applied analogously to the same parts with the same reference numbers and same component names. Also the position details used in the description, such as e.g. top, bottom, side etc. relate to the Figure in question and after a change of position of the article should be transposed to the new position. In addition individual features or combinations of features of the various embodiments shown and described can represent independent solutions of the invention.

Figure 1:
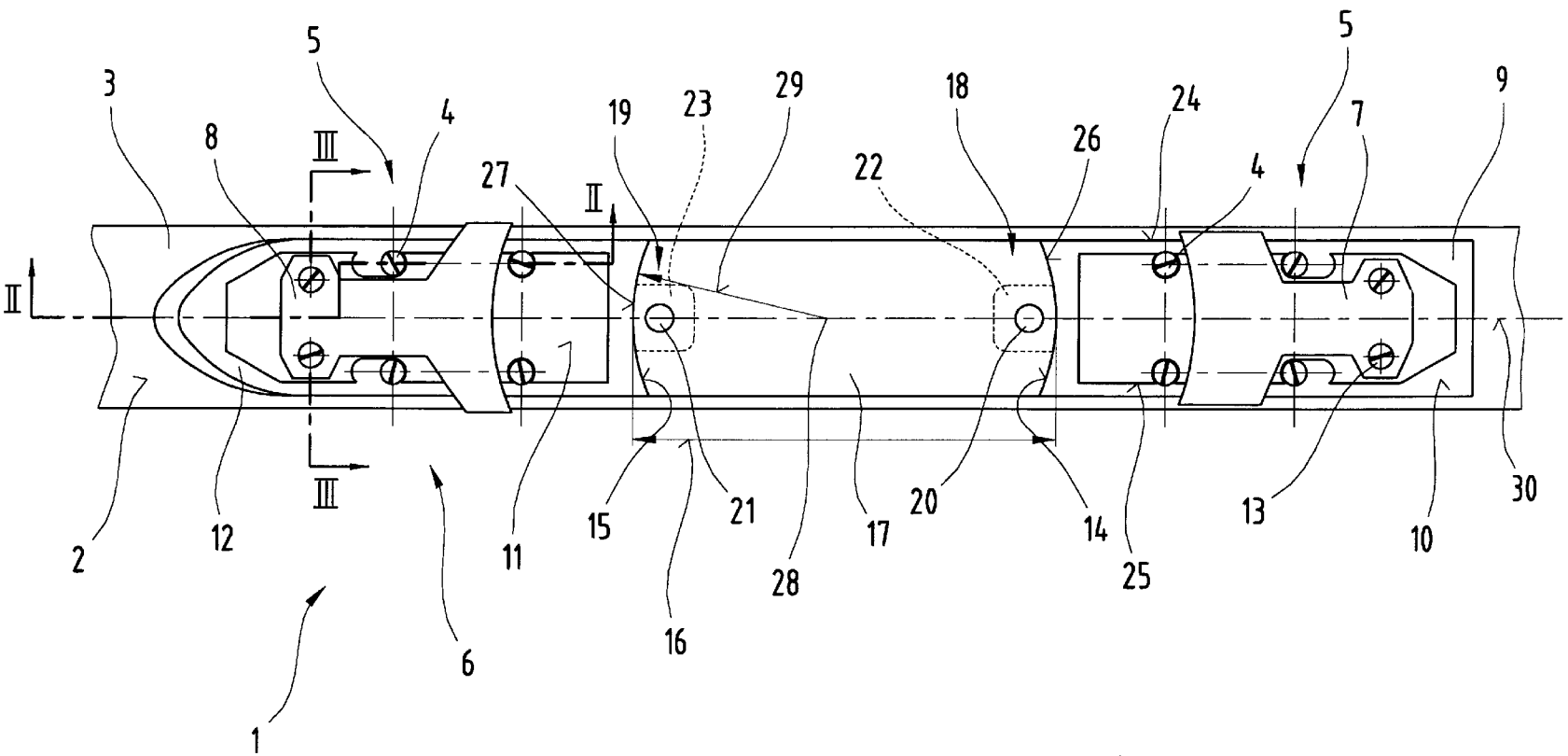
FIG. 1 a support element according to the invention on a ski in plan view.

In FIG. 1 a support element 1 is shown arranged on the surface 2 of a ski 3. The support element 1 is comprised of in several parts along the longitudinal extension of the ski, is secured to the ski 3 by fastening elements 4, and spaces apart the coupling elements 5 of a ski binding 6, in particular a heel piece 7 and a toe piece 8, from the surface 2 of the ski 3. Along the longitudinal direction the support element 1 is divided into a support profile 9 that is designed to be approximately C-shaped in cross section, on the surface 10 of which the heel piece 7 is arranged, and a support profile 12 supporting the toe piece 8 on an upper side 11. The heel piece 7 and the toe piece 8 are secured by so-called binding screws 13 onto the support profiles 9, 12. The support profiles 9, 12 are spaced apart from one another at distance 16 with end faces 14, 15 pointing towards one another. Between the end faces 14, 15 a profiled spacing element 17 extends along the longitudinal extension of the ski, which is hinge mounted in coupling regions 18, 19 by elastically designed hinge arrangements 20, 21 in extensions 22, 23 pointing towards one another and projecting over the end faces 14, 15 of the support profiles 9, 12. Longitudinal side edges 24, 25 of the support element 1 are designed to be curved in accordance with the usual radii of the ski 3. The end faces 14, 15 of the support profiles 9, 12 and opposite end surfaces 26, 27 of the spacing element 17 are circular, whereby a middle point 28 of a radius 29 is arranged on a longitudinal middle axis 30 of the ski 3 and in the region between the end surfaces 26, 27. The spacing element 17 is connected slidingly to the surface 2 of the ski 3 and is only connected to the support profiles 9, 12 by the hinge arrangements 20, 21, whereby the end faces 14, 15 of the support profiles 9, 12 pointing towards one another form sliding surfaces around end surfaces 26, 27 of the spacing element 17, whereby in connection with the elastically designed hinge arrangements 20, 21 the support element 1 follows the movement of the ski 3 with deformation by bending, occurring in particular with a tilted ski 3, with the effect of damping without reinforcing the bending characteristics of the ski 3.

Figure 2:
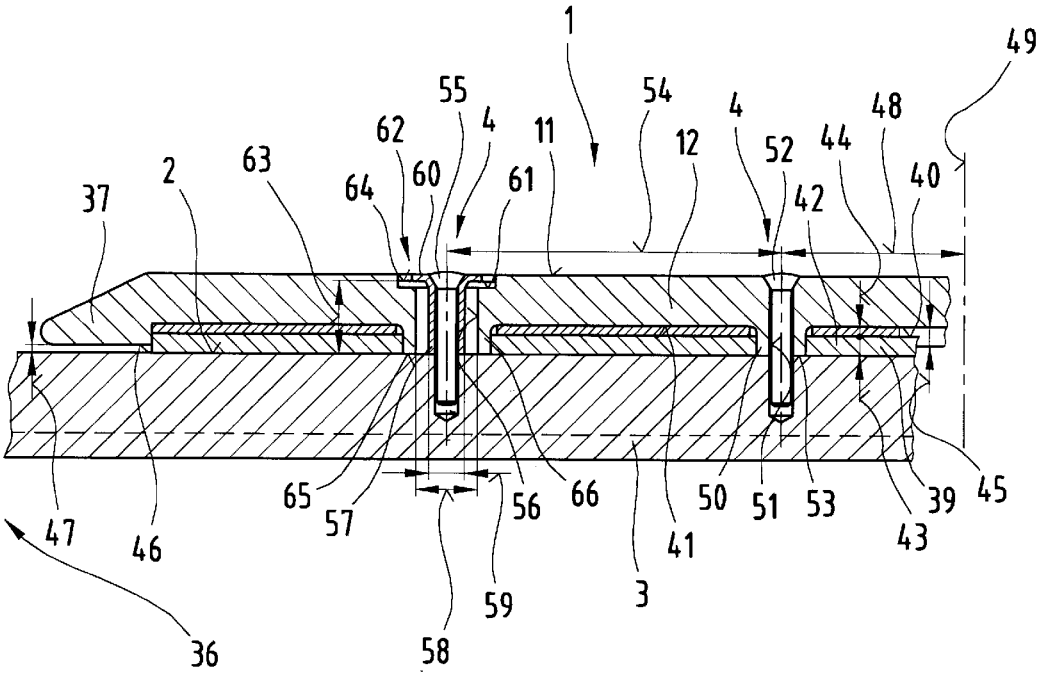
FIG. 2 the support element according to the invention in cross section along the lines III—III of FIG. 1.
Figure 3:
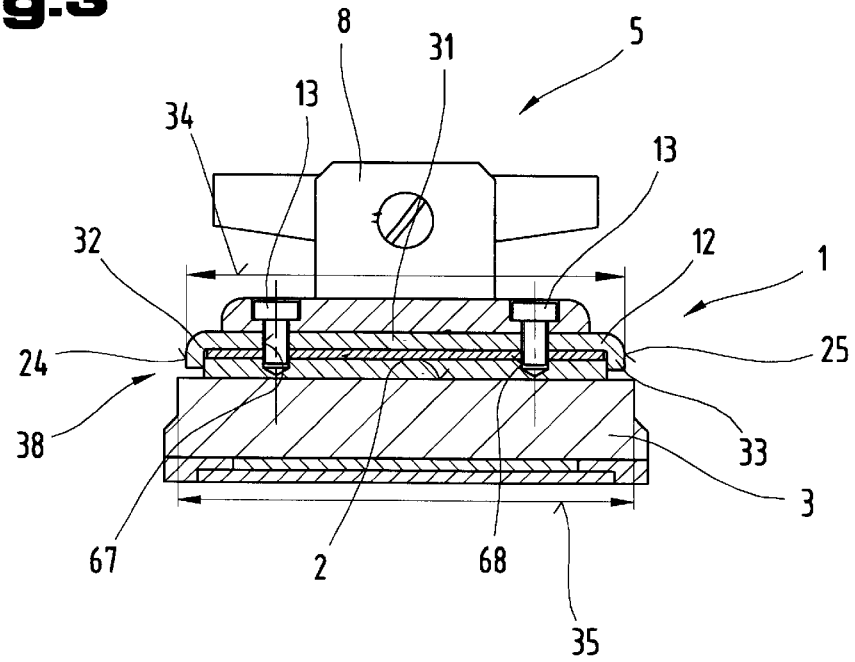
FIG. 3 the support element according to the invention in cross section along the lines III—III of FIG. 1.

In FIGS. 2 and 3 the structure of the support element 1 and its fastening onto the ski 3 and the fastening of the coupling element 5 is shown by the example of the toe piece 8. The description given here in FIGS. 2 and 3 for the support profile 12 mounting the toe piece 8 also applies to the not shown support profile 9 with the heel piece 7 according to FIG. 1. In the embodiment shown the support profile 12 is in the form of a plastic injection moulding with a U-shaped cross section and has a base web 31 running parallel to the surface 2, which is provided with side arms 32, 33 forming the longitudinal side edge 24, 25 and projecting in the direction of the surface 2. The width 34 of the support profile 12 is slightly smaller than the width 35 of the ski 3. In the direction of one ski tip 36 the side arms 32 and the base web 31 are shaped as a kind of spoiler 37. The support profile 12 thus forms a mounting chamber 38 facing the surface 2 of the ski 3, in which lying directly on the surface 2 of the ski 3 a plate-like damping insert 39, preferably made of plastic, e.g. polyethylene foam, is arranged which has excellent vibration damping properties. Between an upper side 40 of the damping insert 39 and an inner surface 41 of the support profile 12 facing the latter, a high-strength insert 42 is arranged, preferably made of a thin-walled metal sheet, especially a titanium alloy. The thickness 43 of the damping insert 39 is slightly greater in respect of the thickness 44 of the insert 42 than the height 45 at which the side arms 32, 33 project over the inner surface 41 of the support profile 12 in the direction of the surface 2 of the ski 3.

Thus it is ensured that end faces 46 of the side arms 32, 33 facing the surface 2 are a short distance 47 from the surface 2 and thus vibrations from the ski 3 are not transferred directly to the support profile 12 but are absorbed by the damping insert 39.

The securing of the support profile 12 to the ski is performed by means of the fastening elements 4. At a first distance 48 from an assembly point of the ski 3 indicated by dash-dot lines the support profile 12 has an annular extension 50 projecting over the inner surface 41 in the direction of the surface 2, which extension is penetrated by a bore 51 which is penetrated in turn by a fastening screw 52. The support profile 12 is secured tightly on the surface 2 by means of the fastening screw 52 by an annular mounting surface 53 formed by the extension 50. At a distance 48 two of these fastening screws 52 are provided in mirror-image to the longitudinal middle axis 30 of the ski 3 in the region of the longitudinal side edges 24, 25.

At a further distance 54 in the direction of the ski tip 36 or analogously in the direction of one ski end and also in the region of the longitudinal side edges 24, 25 and in mirror image to the longitudinal middle axis 30 two further fastening screws 55 are provided. The latter penetrate the support profile 12 in a longitudinal hole 56, which is formed in the support profile 12, whereby the fastening screws 55 are surrounded respectively by a sleeve-like spacing element 57. The length 58 of the longitudinal hole 56 measured parallel to the surface 2 is greater than the external diameter 59 of the spacing element 57. In the region of the upper side 11 of the support profile 12 the spacing element 57 has a flange-like shoulder 60, which with a groove-shaped depression 61 in the support profile 12 forms a guide arrangement 62 for a relative movement between the spacing element 57 and the support profile 12. The support profile 12 is thus mounted in the region of the fastening screw 55 at a distance from the ski surface 2, whereby also the relative movement between the support profile 12 and the ski 3, which occurs on the deformation of the ski due to bending, can be performed unhindered and thereby without reducing the bending characteristics of the ski 3. This is achieved in that a height 63 measured perpendicular to the surface 2 of a guide surface 64 facing the surface 2 of the depression 61 for the flange-like flange 60 is slightly greater than the guide surface 64 of an end surface 65 facing the surface 2 of an edge design 66 of the support profile 12 comprising the longitudinal hole 56.

The coupling element 5, e.g. the toe piece 8, is secured in a known manner on the upper side 11 of the support profile 12 by the binding screws 13.

The binding screws 13 penetrate threaded bores 67 of the base web 31 of the support profile 12 and also threaded bores 68 of the insert 42 arranged between the damping insert 39 and the base web 31, and are screw connected in these threaded bores 67, 68. Thus the fixed arrangement of the coupling element 5 on the support element is achieved which is secured in turn by fastening to the ski 3 as described above.

Figure 4:
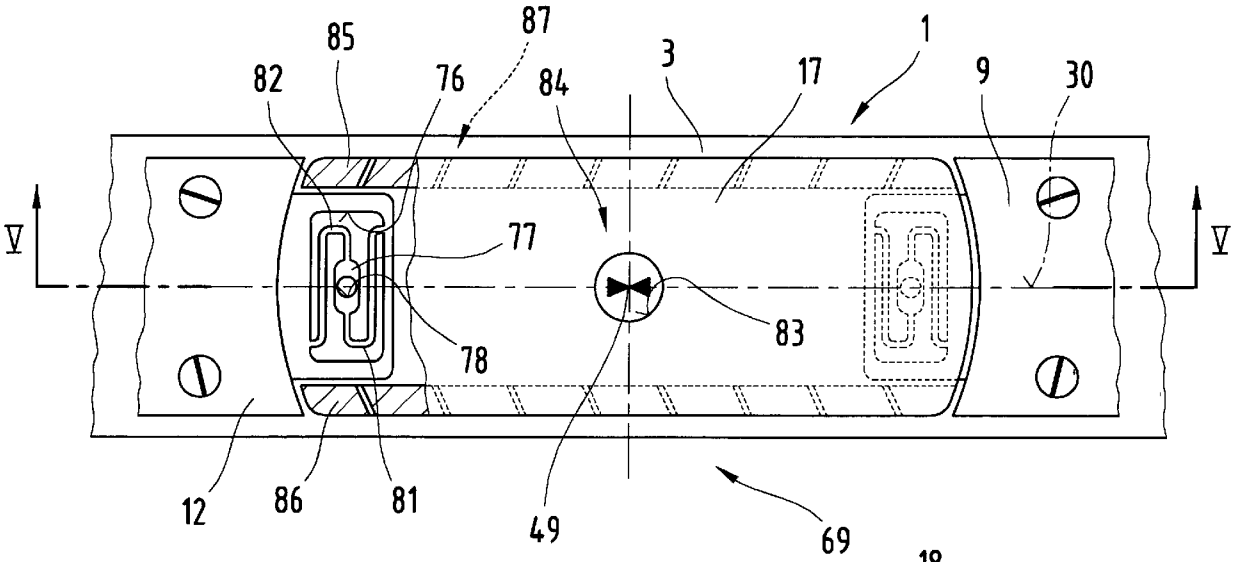
FIG. 4 a part section of the support element according to the invention in plan view.
Figure 5:
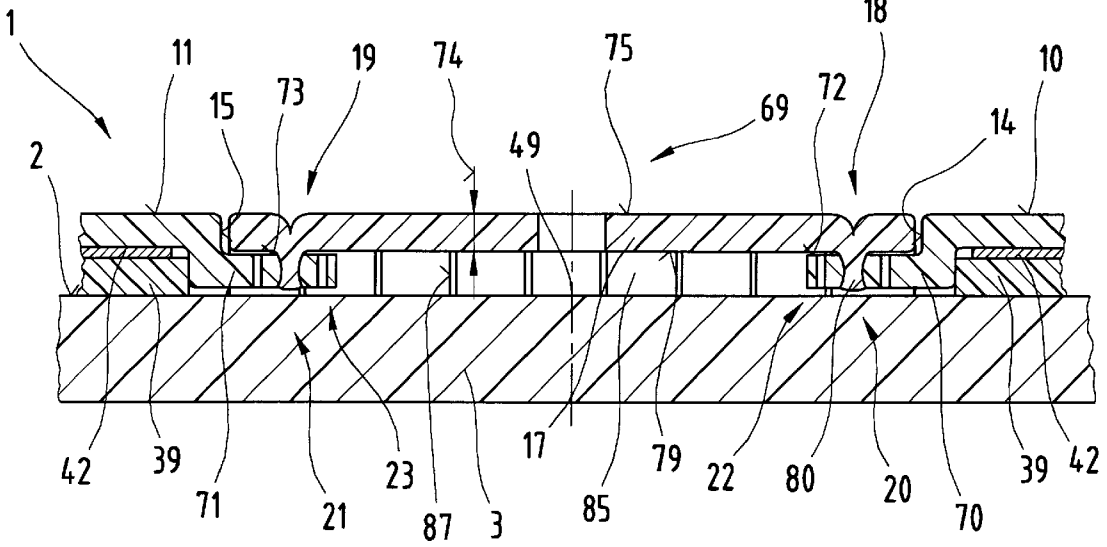
FIG. 5 the support element in cross section along the lines V—V of FIG. 4.

In FIGS. 4 and 5 a middle region 69 of the ski 3 is shown with the support element 1. The support profiles 9, 12 are secured onto the surface 2 with the interconnection of the damping insert 39 and the insert 42, as already described in the previous Figures. Facing the assembly point 49 the end faces 14,15 of the support profiles 9, 12 are projected over by the extensions 22, 23, which are formed by arms 70, 71 running parallel to the surface 2, which are produced by angling the support profiles 9, 12. Upper sides 72, 73 of the arms 70, 71 are placed lower than the upper sides 10, 11 of the support profiles 9, 12 by a thickness 74 of the spacing element 17 connecting the extensions 22, 23 by the hinge arrangements 20, 21. Thus the upper sides 10, 11 of the support profiles 9, 12 run approximately in a plane with an upper side 75 of the intermediate element 17.

The extensions 22, 23 are designed to be frame-like and have an opening 76 that is approximately rectangular in which a coupling element 77 with a mounting opening 78 for a coupling extension 80 projecting over an under side 79 of the intermediate element 17 in the direction of the surface 2 of the ski 3 and formed on the intermediate element 17 is provided. The coupling element 77 is supported elastically in the opening 76 by means of formed meandering webs 81, 82 elastic in all dimensions, as a result of which there is a cardanic suspension of the coupling 77 element. Due to the appropriate dimensioning of the webs 81, 82 and in connection with the elastic properties of the material of the extensions 22, 23 and the support profiles 9, 12 a corresponding damping effects is achieved with relative movements between the spacing element 17 and the support profiles 9, 12 occurring on the deformation of the ski 3. Both coupling regions 18, 19 of the spacing element 17 with the support profiles 9, 12 are designed to be identical forming the hinge arrangements 20, 21, whereby in addition to the cardanic hinge a double hinge design for the support element 1 is provided.

The mounting opening 78 of the coupling element 77 and the coupling extension 80 can be designed in the form a detachable plug connection, as a result of which the spacing element 17 is mounted replaceably on the support profiles 9, 12.

Of course, other connections are possible between the spacing element 17 and the support profiles 9, 12, such as e.g. riveting, screwing etc. The spacing element 17 can also be provided with an observation opening 84 in the form of a bore 83, which makes the assembly point 49 generally found on the surface of the ski 3 visible, as a result of which for the assembly of the support element 1 the removal of the spacing element 17 from the support profiles 9, 12 is not necessary.

The spacing element 17 has a U-shaped cross section running perpendicular to the longitudinal middle axis 30 and lies with side webs 85, 86 on the surface 2 of the ski 3. In said side webs 85, 86 slots 87 running perpendicular to the longitudinal middle axis 30 and to the surface 2 are provided in an arrangement spaced apart from the longitudinal direction of the ski 3. This placing of the spacing element 17 on the surface 2 also provides in connection with the plastic material of the spacing element 17 a vibration damping effect for the ski 3 in the region between the support profiles 9, 12, i.e. in the immediate region on both sides of the assembly point 49. By means of the slots 87 the greatest possible flexibility is achieved. The inclination of the slots 87 is designed to be opposite the direction of travel, as a result of which the penetration of snow, ice, dirt etc. under the spacing element 17 is effectively prevented.

It should also be mentioned that the special effect of the support element 1 according to the invention is also provided in connection with a ski binding type in which the toe piece 8 is secured into position relative to the ski 3 on the support profile 12, and on the support profile 9 a guide arrangement for a so-called free-sliding heel piece 7 is secured, whereby between the toe piece 8 and the heel piece 7 there runs a strip-like connecting element, which absorbs the clamping forces between the coupling elements 5 and a ski shoe.

The support element 1 ensures the secure assembly of the coupling elements 5 and the perfect transmission of force from the ski shoe to the ski 3 for safe skiing without impairing its properties relating to elasticity and bending and avoids the transfer of oscillations and vibration to the skier.

For form's sake it is also mentioned that in the Figures for a better understanding of the structure the support element and its components have been illustrated untrue to scale and/or enlarged and/or reduced in size.

The objective underlying the independent solutions of the invention can be taken from the description.

Principally, the individual embodiments shown in FIGS. 1, 2, 3; 4, 5 can form the subject matter of independent solutions according to the invention. The objectives and solutions of the invention relating thereto can be taken from the detailed descriptions of these Figures.

List of Reference Numbers

1. Support element
2. Surface
3. Ski
4. Fastening element
5. Coupling element
6. Ski binding
7. Heel piece
8. Toe piece
9. Support profile
10. Upper side
11. Upper side
12. Support profile
13. Binding screw
14. End face
15. End face
16. Distance
17. Spacing element
18. Coupling region
19. Coupling region
20. Hinge arrangement
21. Hinge arrangement
22. Extension
23. Extension
24. Longitudinal side edge
25. Longitudinal side edge
26. End surface
27. End surface
28. Middle point
29. Radius
30. Longitudinal middle axis
31. Base web
32. Side arm
33. Side arm
34. Width
35. Width
36. Ski tip
37. Spoiler
38. Mounting chamber
39. Damping insert
40. Upper side
41. Inner surface
42. Insert
43. Thickness
44. Thickness
45. Height
46. End surface
47. Distance
48. Spacing
49. Assembly point
50. Extension

51. Bore
52. Fastening screw
53. Bearing surface
54. Spacing
55. Fastening screw
56. Longitudinal hole
57. Spacing element
58. Length
59. Diameter
60. Flange
61. Depression
62. Guide arrangement
63. Height
64. Guide surface
65. End surface
66. Edging
67. Threaded bore
68. Threaded bore
69. Middle region
70. Arm
71. Arm
72. Upper side
73. Upper side
74. Thickness
75. Upper side
76. Opening
77. Coupling element
78. Mounting opening
79. Underside
80. Coupling extension
81. Web
82. Web
83. Bore
84. Observation opening

What is claimed is:

1. A plate-like support element for a heel piece and a toe piece of a ski binding, the support element comprising, along a longitudinal extension of the ski, (a) a first support profile supporting the heel piece, (b) a second support profile supporting the toe piece, (1) the support profiles having circular end surfaces facing each other and (2) the end surfaces having extensions pointing towards each other, (c) a spacing element distancing the support profiles from each other in the longitudinal extension of the ski, (1) the spacing element having opposite circular end surfaces adjacent the circular end surfaces of the support profiles, and (2) a middle point of the circular end surfaces lying on a longitudinally extending center axis of the ski between the end surfaces, (d) elastic hinge arrangements on the extensions of the support profiles for connecting the spacing element to the support profiles, and (e) plate-like damping inserts spacing the support profiles from a surface of the ski.

2. The support element of claim 1, further comprising sheet metal inserts having a tensile strength of more than 500 N/sq.mm arranged between the damping inserts and the support profiles.

3. The support element of claim 2, wherein the support profiles have an approximately U-shaped cross section comprised of a base web and peripheral side webs, and the damping and sheet metal inserts are surrounded by the peripheral webs of the U-shaped support profiles.

4. The support element of claim 3, further comprising binding screws fastening the heel and toe pieces to the support profiles, the binding screws passing through threaded bores in the metal sheet inserts and projecting only partially into the damping inserts.

5. The support element of claim 1, wherein the heel piece is fastened to the first support profile, the toe piece is fastened to the second support profile, and further comprising a fastening arrangement securing each support profile to the surface of the ski.

6. The support element of claim 5, wherein the fastening arrangement comprises at least one fixed bearing and at least one movable bearing.

7. The support element of claim 6, wherein the movable bearing comprises a sleeve-like spacing element arranged between the support profile and the surface of the ski.

8. The support element of claim 7, further comprising a guide groove for the support profile, the guide groove extending in the longitudinal extension of the ski and the sleeve-like spacing element having a shoulder received in the guide groove.

9. The support element of claim 7, further comprising a fastening screw passing through the sleeve-like spacing element and securing the sleeve-like spacing element to the surface of the ski.

10. The support element of claim 1, wherein the plate-like damping inserts are made of foamed plastic.

11. The support element of claim 1, wherein the plate-like damping inserts have a thickness between 3 mm and 10 mm.

12. The support element of claim 1, wherein the hinge arrangements comprise an elastic coupling element arranged in an opening of the extensions of the support profiles and a coupling extension of the spacing element in engagement with the coupling element.

13. The support element of claim 1, wherein the hinge arrangements comprises Cardan joints.

14. The support element of claim 1, wherein the hinge arrangement is arranged to permit a relative movement between the support profiles and the spacing element in all directions.

15. The support element of claim 1, wherein the support profiles are made of injection molded plastic.

16. The support element of claim 1, wherein the spacing element is made of injection molded plastic.

17. The support element of claim 1, wherein the spacing element has an approximately U-shaped cross section extending perpendicularly to the longitudinal extension of the ski and having side webs supporting the spacing element on the surface of the ski.

18. The support element of claim 17, wherein the side webs are inclined towards a center longitudinal axis of the ski and have slots extending perpendicularly to the surface of the ski.

* * * * *